US006247230B1

(12) United States Patent
Hart et al.

(10) Patent No.: US 6,247,230 B1
(45) Date of Patent: Jun. 19, 2001

(54) IMPACT TOOL HEAD WITH CUTTING BLADES

(76) Inventors: William E. Hart, 6308 Pises; James B. Hart, 5550 Lake Lindero Rd., both of Agoura Hills, CA (US) 91301; Jackson Robert, 22903 De Kalb Dr., Calabasas, CA (US) 91302

( * ) Notice: Subject to any disclaimer, the term of this patent is extended or adjusted under 35 U.S.C. 154(b) by 0 days.

(21) Appl. No.: 09/295,475

(22) Filed: Apr. 19, 1999

(51) Int. Cl.[7] ..... H01R 43/00

(52) U.S. Cl. ..... 29/866; 29/33 M; 29/566.3; 29/566.4

(58) Field of Search ..... 29/866, 865, 861, 29/566.4, 33 M, 566.3, 566.1; 30/348

(56) References Cited

U.S. PATENT DOCUMENTS 3,604,115 * 9/1971 McDonald ..... 30/348
3,708,852 * 1/1973 Mason ..... 29/566.4
3,898,724 * 8/1975 Conorich ..... 29/566.4
4,315,444 * 2/1982 Perrino et al. ..... 76/101 R
4,409,713 * 10/1983 Johnston ..... 29/33 M
4,625,386 * 12/1986 Bieganski ..... 29/566.4
5,046,252 * 9/1991 Ayuta et al. ..... 29/566.4 X
5,832,603 * 11/1998 Fallandy ..... 29/861
5,996,224 * 12/1999 Sullivan ..... 29/863

* cited by examiner

*Primary Examiner*—William Briggs
(74) *Attorney, Agent, or Firm*—Tope-Mckay & Associates

(57) ABSTRACT

An improved impact tool head having separate and distinct pressing and cutting blades integrally molded therein. The impact tool head allows for independent and optimal material and dimensional design of the pressing blades and the cutting blades to minimize impact damage to a terminal block and to ensure longer useful tool life. Also, through the use of multiple components, the impact tool head is readily adaptable to a wide variety of different terminal block configurations. Furthermore, sets of pressing blades and sets of cutting blades may be formed with each set comprising a continuous piece of material in order to simplify manufacturing and to ensure uniformity of production. Additionally, the integral molded structure is designed to allow post-molding sharpening of the cutting blades in order to ensure blade uniformity to further improve blade durability.

15 Claims, 13 Drawing Sheets

IMPACT TOOL HEAD WITH CUTTING BLADES

TECHNICAL FIELD

The present invention relates generally to tools employed in the telecommunication industry for seating and cutting the free ends of wires inserted into resilient telephone wire terminal receptacles such as the AT&T/Lucent Technologies RJ-45/M-series type jacks. It is more particularly directed to a new and improved wire-insertion and cutting tool head, geometrically configured to match a resilient telephone wire terminal receptacle such that when pressure is applied to the head from a source such as a handle, the head will provide means by which to seat and cut multiple wires that have been inserted into the wire terminal receptacle. Thus, with one impact, a multiplicity of wires may be simultaneously seated into a wire terminal receptacle and cut.

BACKGROUND OF THE INVENTION

Tools for terminating electrical conductors at terminal clips or blocks are widely used in the telephone industry. Currently, there is a wide variety of such instruments, generally serving the purpose of cutting and seating individual telephone wires. Examples of a few such tools may be found in U.S. Pat. Nos. 5,832,603; 5,758,403; 5,628,105; 4,656,725; and 4,161,061 and the patents cited therein.

Typical impact tools include an elongated handle and an impact head for cutting and seating wires in a terminal block. Such a handle may contain a hammer element and a compression spring arranged such that the spring actuates the hammer, causing it to strike the impact head. Thus, the hammer provides an impact force that causes the impact head to cut and seat the wires into the terminal block. In operation, the impact head is aligned with, and pushed into, a terminal block. As the handle is pressed, the spring is released, forcing the hammer against the impact head. The force stored in the spring is thus translated into the impact head, thereby forcibly cutting and seating one or more wires in the terminal block. In place of handles, some impact tools utilize electric motors to provide the impact force; thereby reducing the manual strength required to seat and cut the wires in a terminal block.

With the increasing complexity of terminal blocks and the need for technicians and craftspersons to efficiently use their time, a need arose to develop means by which multiple wires can be cut and seated simultaneously. Early solutions to this problem, although providing great improvements over prior single-wire seating and cutting techniques, have met with limited success.

Examples of these solutions include wire-insertion and cutting heads such as those employed by AT&T model 788J1 and Seimens model S788J impact tools. Illustrations of these tools, which comprise separate wire-insertion and seating blade support blocks and knife blade support blocks are provided in FIGS. 1 and 2, respectively. The wire-insertion and seating blade block includes a plurality of slotted copper wire-insertion blades 1 captured within respective slots 3 formed in a region of the base block 5 and extending into respective standoffs 7 in the wall of the base block 5. A base region 9 with ribs 11 is formed on one side of the wire-insertion and seating blade block in order to accept the knife blade support block. The knife blade support block 21 is made of an injection molded insulating material and contains a plurality of razor blade-like cutting knives 23 securely retained therein. Depressions 25 are molded into the base of the knife blade support block 21 in order that the ribs 11 of the wire-insertion and seating blade block may be received such that the wire-insertion and seating blade block and knife blade support block 21 may be maintained in an operative relationship during use. FIGS. 3 and 4 demonstrate this impact head in an operative relationship with a terminal receptacle 31 during normal operation. As depicted, the dimensions of the impact head are chosen such that the contacts 33 in the terminal receptacle 31 are bridged by the slotted copper wire-insertion blades 35 of the wire-insertion and seating blade block 37. When the impact head is actuated, the wire 39 is pressed against the bottom surface 41 of the slot in the terminal receptacle 31 and the end of the wire 43 is severed by the cutting knives 23 of the knife blade support block 21. During this process, the contacts cut into the wire jacket 45, electrically contacting the wire 39. Unfortunately, the experience of technicians and craftspersons has revealed a major shortcoming of this design, as depicted in FIG. 5. In this case, the impact head has been actuated but did not cut the wire. This problem is the result of the two-piece design of the impact head and the associated play between the parts. Even when the two pieces are properly aligned, a small amount of play is allowed therebetween. Furthermore, small particulate pieces of matter such as plastic from the terminal block or pieces of wire insulation may become lodged between the impact head pieces, causing malfunction. Additionally, this problem may be caused or exacerbated by failure to properly align the impact tool with the terminal receptacle. Any wires remaining uncut must be individually severed with the use of a separate tool.

An attempt to correct these shortcomings is disclosed in U.S. Pat. No. 5,836,069 and U.S. Pat. No. 5,628,105, the first being to an impact tool head having a plurality of unitary pressing and cutting blades and the second being to a wire termination tool in which the impact tool head is incorporated. In order to solve the problem of misalignment between parts, this impact head included an injection-molded piece with a plurality of integrally formed wire-seating and cutting blades. Thus, the misalignment problems associated with the two-piece impact head design were overcome.

In order to construct the one-piece impact head, as detailed in U.S. Pat. No. 5,836,069, a plurality of integrally formed wire-seating and cutting blades 60 such as the one shown in FIG. 6 are positioned in a molded support block 70 as shown in FIG. 7, such that they are aligned in a generally parallel fashion. The final assembly for an impact head of this type is shown in FIG. 8. The use of this impact head in alignment with a terminal receptacle of a termination block is demonstrated in FIG. 9. This design's main advantage is that the cutting blade is forced to remain in alignment with the rest of the tool, thus eliminating the problem of uncut wires due to play between the parts. Although this design increases the wire-cutting reliability of the impact head, it suffers from several important drawbacks. First of all, the integrally formed wire-seating and cutting blades, because of their integral nature, must be fabricated from a material that is functional for both cutting and seating wires. As such, the material must be soft enough to minimize damage to the terminal receptacle, yet be hard enough to provide a durable cutting instrument. Because damage minimization and durability as a cutting surface are somewhat conflicting requirements, a manufacturer must make a compromise between the two functions when choosing materials. Second, the design of the integrally formed one-piece impact head is such that post-fabrication sharpening of the blades is not practical. Consequently, differences in blade length due to positioning variations of the integrally formed wire-seating and cutting blades in the mold results in a more rapid dulling of some blades than of others. As some blades dull and others remain sharp, it is likely that not all of the wires will be cut with one impact, and therefore, multiple impacts will be required to cut and seat the wires in a terminal. Multiple impacts not only require additional time and labor but may also cause structural damage to the terminal head. Furthermore, dull blades require a more powerful impact for successful cutting, which may cause structural damage as well. Third, because this design requires the placement of a plurality of integrally formed wire-seating and cutting blades in the mold prior to fabrication, consistent alignment is difficult and manufacture is costly.

The invention disclosed herein overcomes these difficulties by providing a one-piece integrally molded impact head having distinct pressing and cutting blades which can be chosen from different materials to optimize the seating and cutting functions independently. Additionally, the dimensions of the pressing and cutting blades may be independently chosen to optimize their effectiveness in their distinct roles. Furthermore, the integral molded structure is designed such that the blades may be sharpened after the molding process is complete, thus ensuring blade uniformity for improved durability. Finally, the design of the impact tool head disclosed herein, because of its multi-component nature, is readily adaptable to different terminal block configurations, and may optionally be made to press wires into the grooves of only one terminal ridge and to cut the wires on only one side of the terminal ridge. Thus, the impact tool head disclosed herein provides an improved device for cutting and seating wires in the same terminal blocks as the prior-art tools just described, such as a Lucent 110-type terminal block. Further, the present invention may economically constructed such that it may cut and seat wires across a plurality of terminal ridges in a Lucent 110-type terminal block, thus providing for further improvement over the prior-art tools.

SUMMARY OF THE PRESENT INVENTION

In accordance with the present invention, an improved impact tool head having separate and distinct pressing and cutting blades integrally molded therein is presented. This impact tool head allows different materials to be chosen for the pressing blades and for the cutting blades. Thus, it provides the ability to optimize both the pressing and the cutting processes independently without the compromises necessitated by having separate blocks for the pressing and cutting blades or by the use of a single uniform material piece for both the pressing and cutting blades. Additionally, sets of pressing blades and sets of cutting blades may be formed, each set comprising one continuous piece of material in order to reduce manufacturing costs and to ensure uniformity of production. Also, by allowing the pressing blades and cutting blades to be formed separately, adjustments in the dimensions of each may be made independently of the other. Thus, it is possible to ensure optimal design of each and to adapt the design to the needs of a variety of terminal block configurations. Furthermore, the integral molded structure is designed to allow post-molding sharpening of the cutting blades in order to ensure blade uniformity for improved durability.

DETAILED DESCRIPTION

Figure 10:
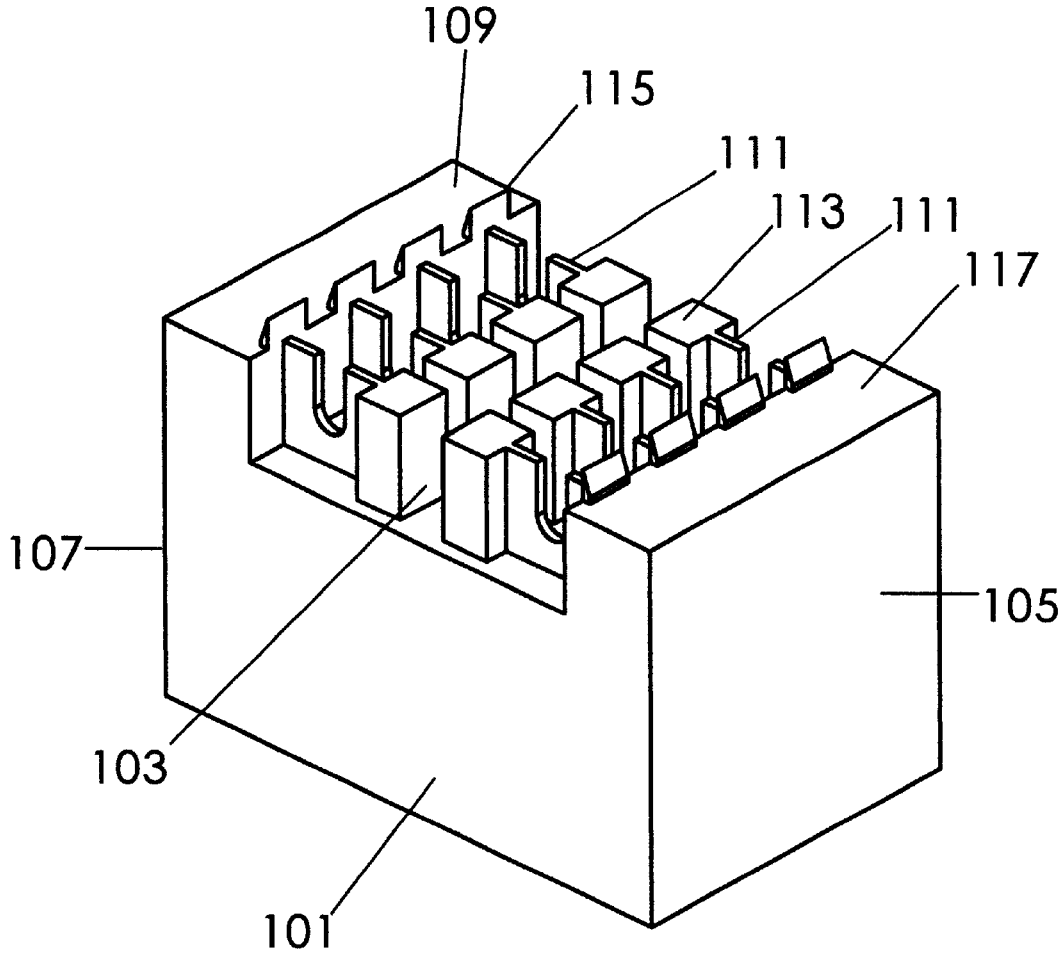
FIG. 10 is a perspective view of a preferred embodiment of an assembled impact tool head according to the present invention.

A perspective view of a preferred embodiment of an assembled impact tool head according to the present invention is shown in FIG. 10. The impact tool head is of generally rectangular shape, including a support block body 101 formed of an injection-moldable and suitably resilient insulating material, preferably a plastic material such as liquid crystal, ryton, ultem, or mineral filled nylon. The support body block 101 includes a longitudinal groove 103 formed in the body material and extending along the length of the support body block 101 between end faces 105 and 107. The longitudinal groove 103 opens on a generally planar surface 109 and is sized to accommodate a multiple terminal wire cable within the terminal block. Pairs of pressing blades 111 reside perpendicular to, and on either side of the longitudinal groove 103. The tops of the pressing blades 111 are substantially planar with the generally planar surface 109. Cutting blade portions 115 extend perpendicularly beyond the generally planar surface 109 and abut the pressing blades 111 opposite the longitudinal groove 103. In this particular embodiment, shoulders 117 are formed adjacent the cutting blade portions 115 and opposite the pressing blades 111 on the generally planar surface 109 to allow the impact tool head to be grasped within an impact tool. The dimensions of the individual pieces of the impact tool head may be chosen to allow usage with differently sized and configured terminal blocks.

Figure 11:
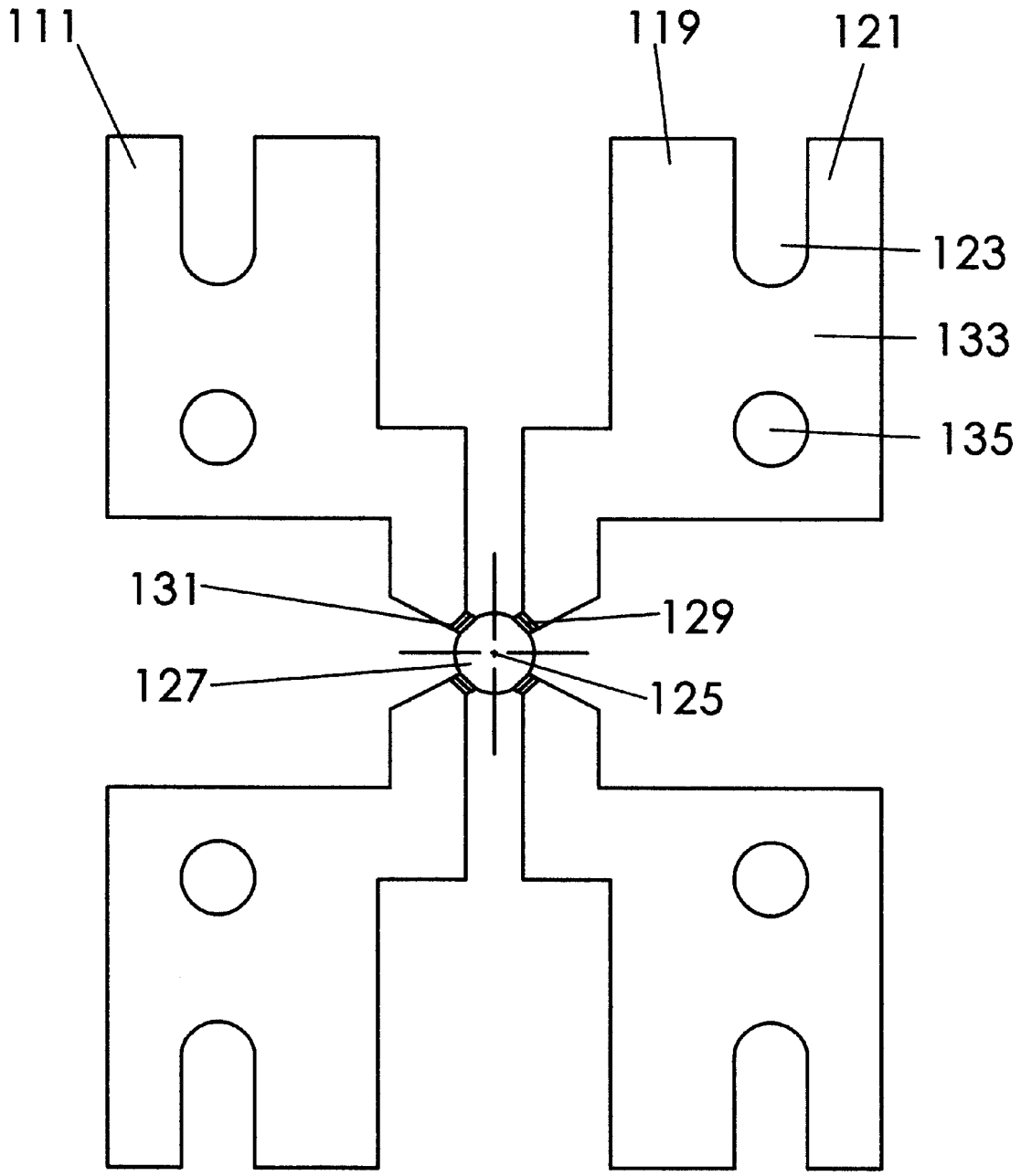
FIG. 11 is a front view of an embodiment of a set of four of separate and distinct pressing blades according to the present invention.
Figure 12:
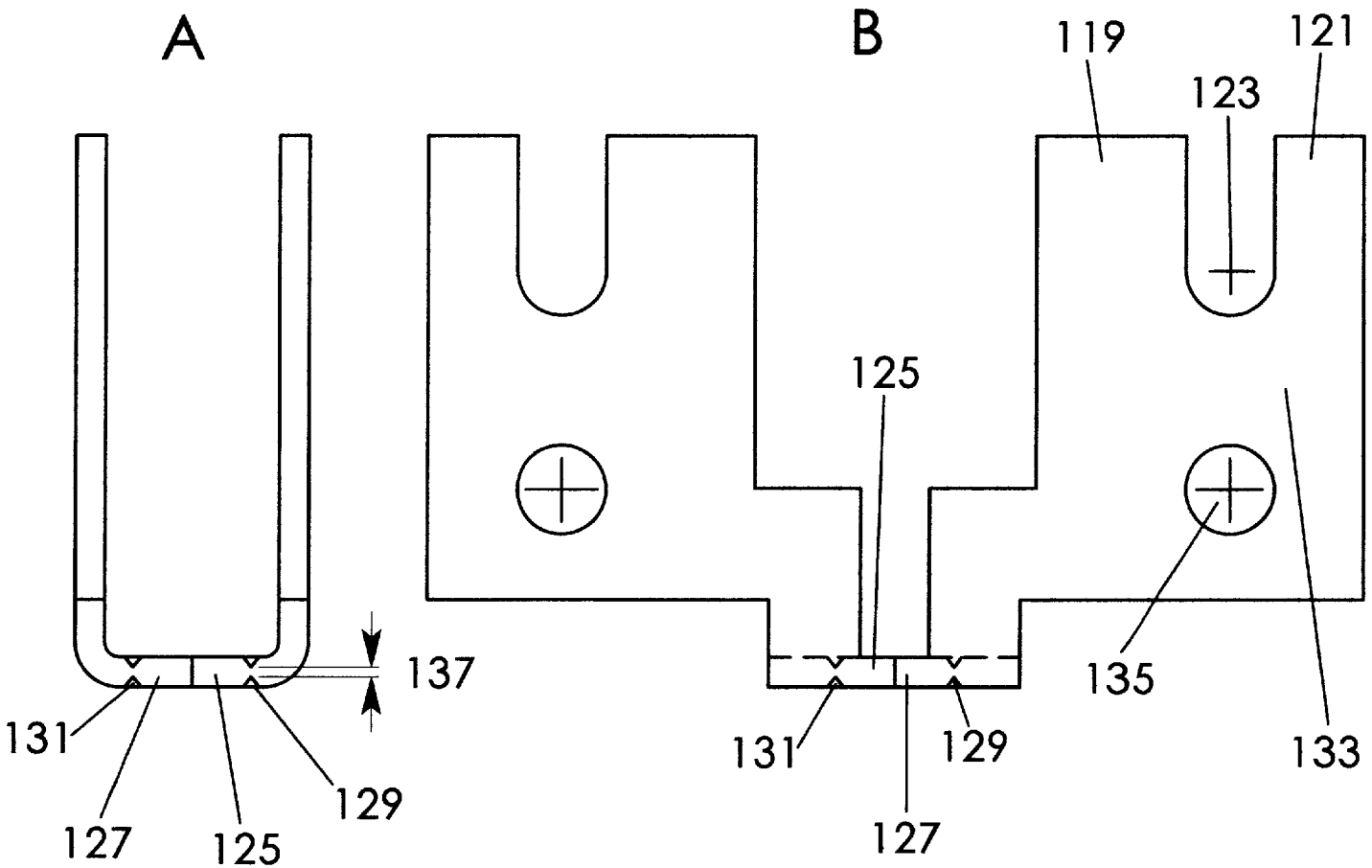
FIG. 12*a* is a front view of an embodiment of a pair of separate and distinct pressing blades according to the present invention.
FIG. 12*b* is a side view of an embodiment of a pair of separate and distinct wire-pressing blades according to the present invention.

Two versions of a pre-assembly embodiment of wire-pressing blades according to another version of the invention are shown in FIGS. 11 and 12, respectively. The version of FIG. 11 demonstrates the manufacture of four wire-pressing blades in one unit and the version of FIG. 12*a* and FIG. 12*b*, respectively, demonstrate front and side views of the manufacture of two wire-pressing blades as a single unit. The pressing blades 111 are formed of a resilient material sufficiently durable to endure many impacts, e.g. beryllium copper, a carbon composite, or other sufficiently hard material. The material of the pressing blades 111 is preferably chosen to avoid chemical interaction with the cutting blades 115. The pressing blades 111 each include a first pressing surface 119 and a pressing surface 121 separated by a straddle portion 123 which forms a substantially U shape therebetween. The dimensions of the straddle portion 123 are chosen such that the first pressing surface 119 and the second pressing surface 121 press a wire into a terminal slot without contacting or damaging the terminal contacts during operation (FIGS. 16 and 17 with their accompanying explanations will provide further information in this regard). In the embodiments of FIGS. 11 and 12, sets of pressing blades are formed as a single piece, connected by a center portion 125 having a breakable portion 127. Notches 129 and 131 may be formed in the center portion 125 on either side of the breakable portion 127 to permit easy removal after molding so that electrical conduction is impossible between adjacent pressing blades. This is necessary to prevent electrical shorting between adjacent conductors in a terminal block during operation of the impact tool head. The pressing blades 111 further include seating portions 133, which preferably include locking holes 135 through which injection-moldable material flows and hardens during molding to fixedly hold the pressing blades 111 in place within the impact tool head. FIG. 12*b* provides a side view of a pair of wire-pressing blades according to the invention in order to more specifically show the relationship between the pressing blades 111, the center portion 125, the breakable portion 127, and the notches 129 and 131. Additionally, the thickness 137 of the pressing blades 111 is chosen to allow for optimal fit when pressing wires into a slot in particular terminal block.

Figure 13:
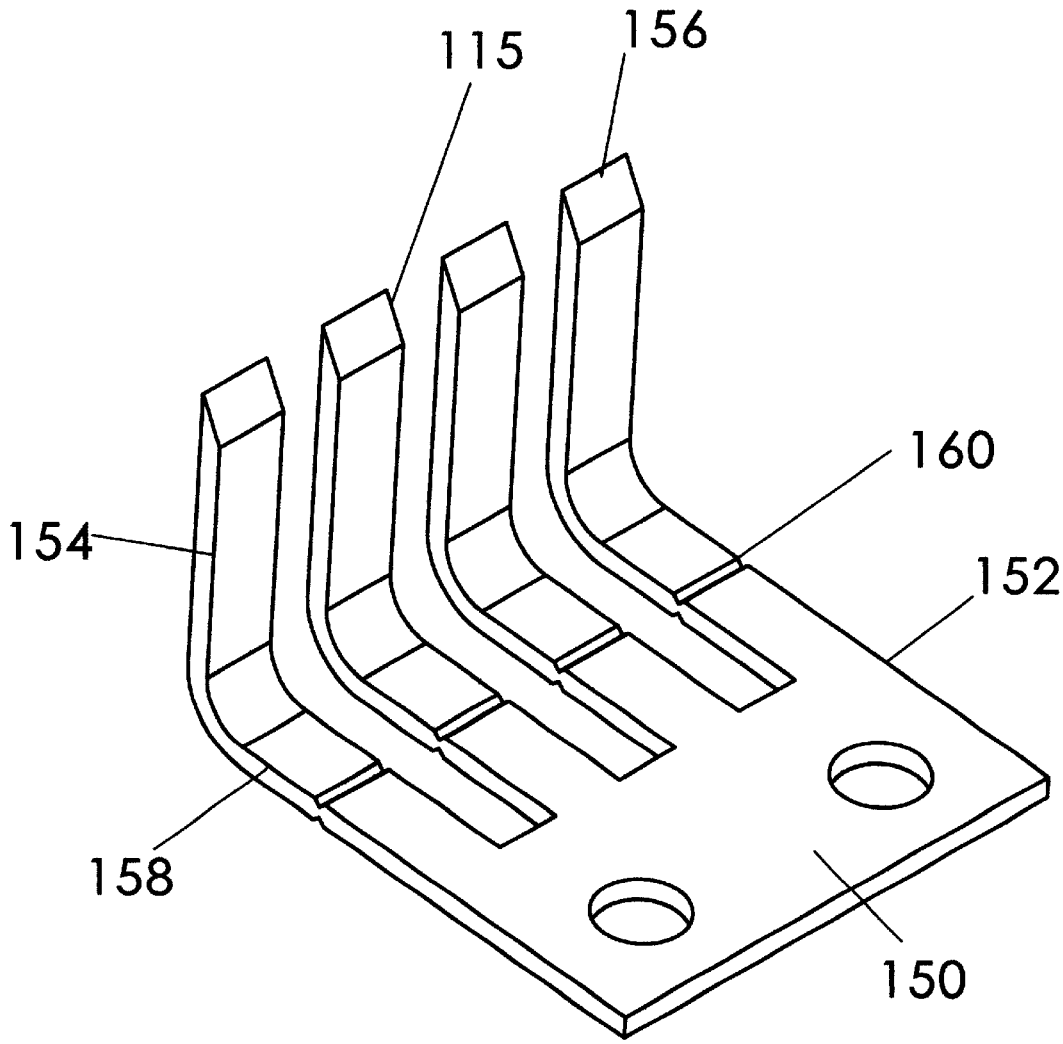
FIG. 13 is a perspective view of a pre-assembly embodiment of a wire-cutting blade set according to the present invention.

A pre-assembly embodiment of a wire-cutting blade set 150 according to the invention is shown in a perspective view in FIG. 13. The set of wire-cutting blades 150 is formed of a hardened material such as 440C steel, and includes a breakaway portion 152 from which extend one or more cutting blades 154 each including a cutting blade portion 115 with a bevel-shaped cutting end 156 formed thereon. An arched locking portion 158 is formed between the breakaway portion 152 and the bevel-shaped cutting ends 156 along the cutting blade portions 15 in order to help hold the wire-cutting blade set 150 rigidly in place within the impact head after the molding process. The arched locking portion 158 preferably takes the shape of a roughly 90-degree arc, as shown in the figure. Also, the cutting blades 154 are preferably formed as individual blades as shown in FIG. 13, but could be formed as a single, wider, blade. Between the arched locking portion 158 and the breakaway portion 152, breakaway notches 160 are preferably formed to allow for easy removal of the breakaway portion after the molding process is complete.

Figure 14:
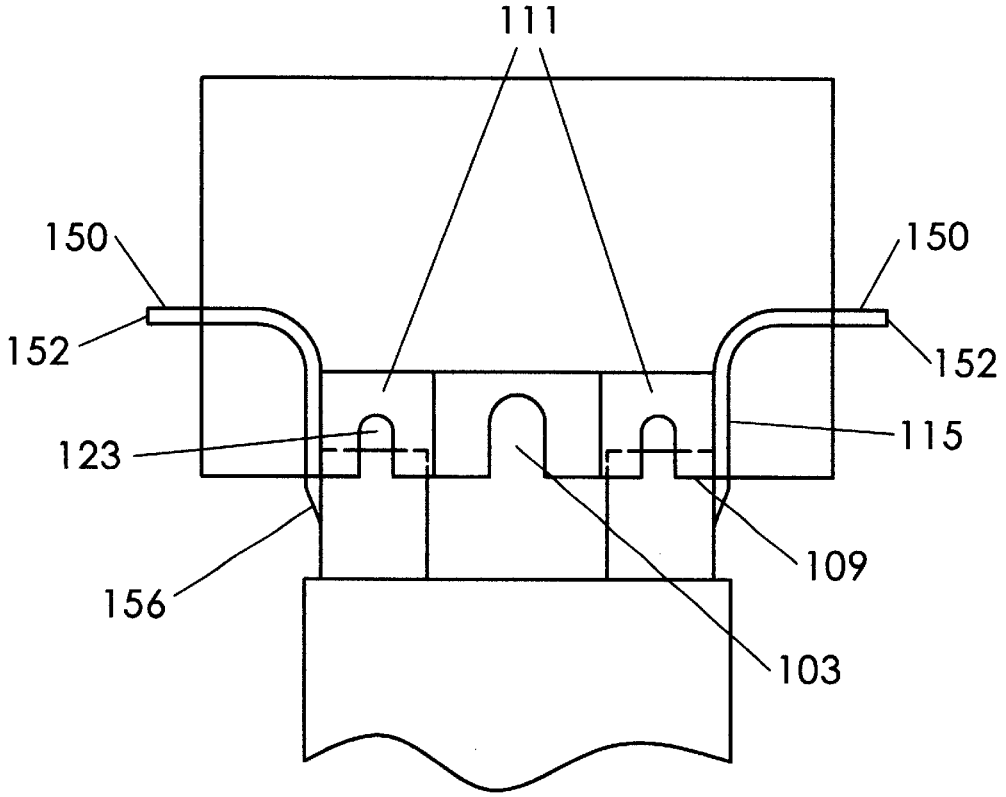
FIG. 14 is a cutaway side view demonstrating the operative alignment of the separate and distinct wire-pressing blades and wire-cutting blades within the impact tool head according to an embodiment of the present invention.
Figure 15:
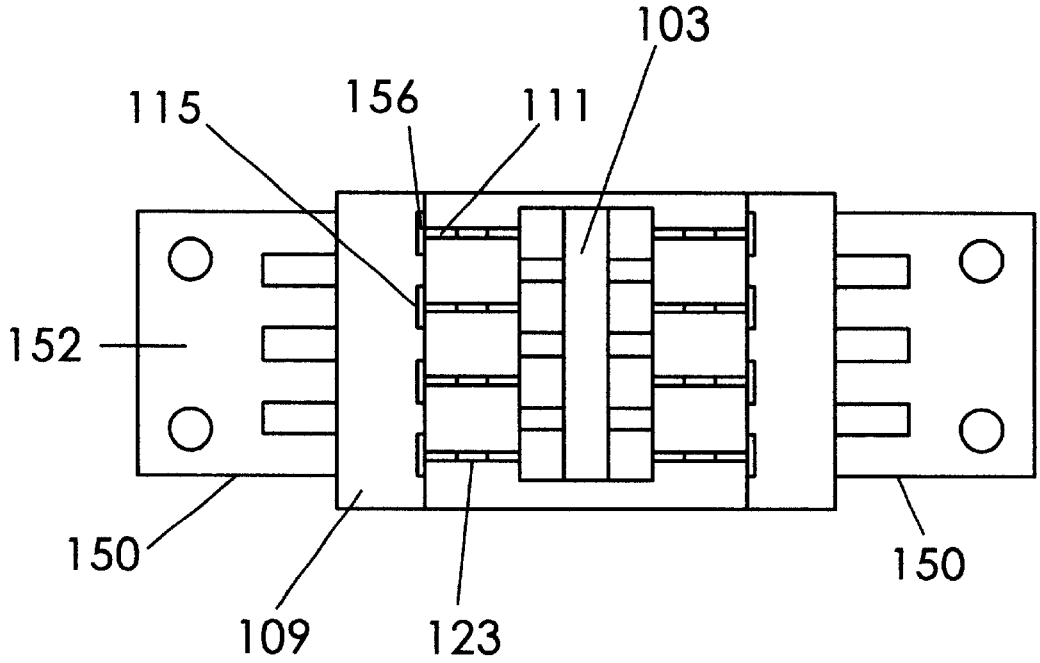
FIG. 15 is a cutaway front view demonstrating the operative alignment of the separate and distinct wire-pressing blades and wire-cutting blades within the impact tool head according to an embodiment of the present invention.

Cutaway side and front views demonstrating the operative alignment of the wire-pressing blade pairs 111 and the wire-cutting sets 150 within the impact tool head of the present invention are presented in FIGS. 14 and 15, respectively. In manufacture, a mold cavity of an injection mold apparatus is preloaded with one or more pairs of pressing blades 111 and two wire-cutting blade sets 150 such that the breakable portion 125 of the pressing blade pairs 111 (see FIGS. 11 and 12) resides in the portion of the mold which will form the longitudinal groove 103 of the impact head; such that the pressing blade pairs 111 reside so that after molding they will be substantially planar with the generally planar surface 109 of the impact tool head; and such that the after molding, the bevel-shaped cutting ends 156 of the wire-cutting blade sets 150 extend perpendicularly beyond the generally planar surface 109 of the impact tool head. The number of pressing blade pairs 111 equals the number of cutting blade portions 115 in each wire-cutting blade set 150 (see FIG. 13). The exact number of pressing blade pairs 111 and cutting blade portions 115 is tailorable to the requirements of a particular terminal block. Additionally, dimensions of the wire-pressing blade pairs 111 and the wire-cutting blade sets 150 may be chosen for compatibility with a particular terminal block. These dimensional choices include not only the overall scale, but also the dimensions of particular features of the individual pieces, e.g. adjustment of the depth of the straddle portion 123 of the pressing blades 111 to accommodate different wire contacts or of the length of the cutting blade portions 115 of the wire-cutting blade sets 150 to vary the distance by which the bevel-shaped cutting ends 156 extend beyond the generally planar surface 109 of the impact tool head. During the molding process, various means for attaching the impact tool head may be included, depending on needs of the impact device with which it is to be used, e.g. threaded holes in the molding material, shoulders 117 formed adjacent the cutting blades 115 and opposite the pressing blades 111 (see FIG. 10), etc. After molding, the breakable portion 125 (see FIGS. 11 and 12) is removed from the longitudinal groove 103 of the impact tool head to clear it from obstruction. The breakaway portions 152 of the wire-cutting blade sets 150 are also removed.

Figure 16:
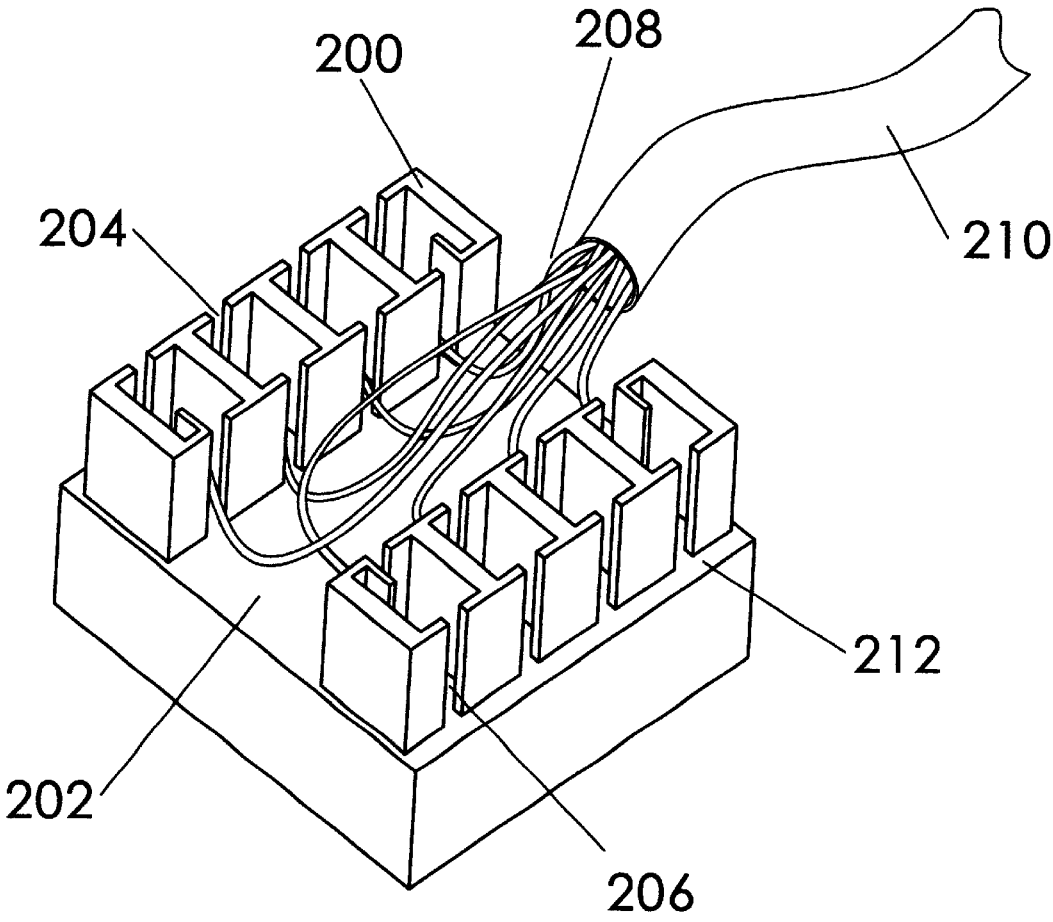
FIG. 16 is a perspective view of an example of a terminal block with which the impact tool head of the present invention would be used.

A perspective and partial cut-away view of an example of a terminal block with which the impact tool head of the present invention would be used is shown in FIG. 16. In this particular case, the terminal block shown is configured as a Lucent RJ-45 terminal block. However, the impact tool head of the invention can be configured compatibly with any geometrically similar configuration. As shown in the figure, the terminal block is of a generally block shape, and includes a two substantially planar ridges 200 formed on either side of a longitudinal wire receptacle 202. A plurality of wire terminal grooves 204, each including an electrically conductive contact 206 therein, are formed in the substantially planar ridges 200. Individual wires 208 from a multiple-wire cable 210 are placed in an operative relationship with the wire terminal grooves 204 as shown, such that they may be pressed and cut by the impact tool head. The terminal block of the example further includes longitudinal anvil-ridge portions 212 along its exterior, positioned to act as anvils against which the individual wires 208 may be cut as they are seated in the terminal grooves 204. The electrically conductive contacts 206 are designed such that they penetrate and form an electrical connection with the individual wires 208 as they are seated within the terminal grooves 204.

Figure 1:
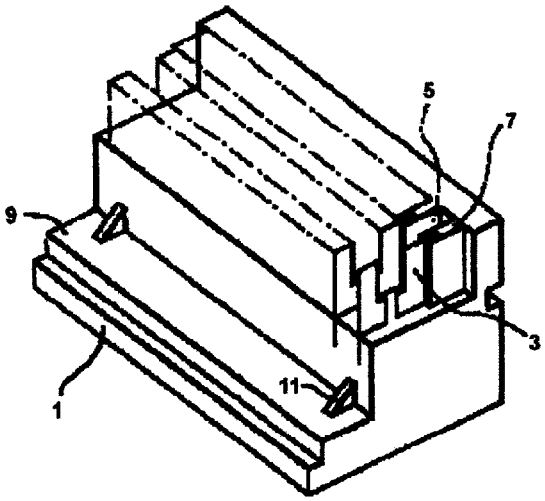
FIG. 1 PRIOR ART
FIG. 1 is a perspective view of wire-insertion and seating blade block of a conventional two-piece wire-insertion and cutting impact head assembly.
Figure 2:
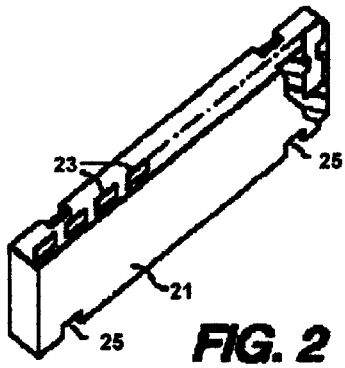
FIG. 2 PRIOR ART
FIG. 2 is a perspective view of a knife blade support block of a conventional two-piece wire-insertion and cutting impact head assembly.
Figure 3:
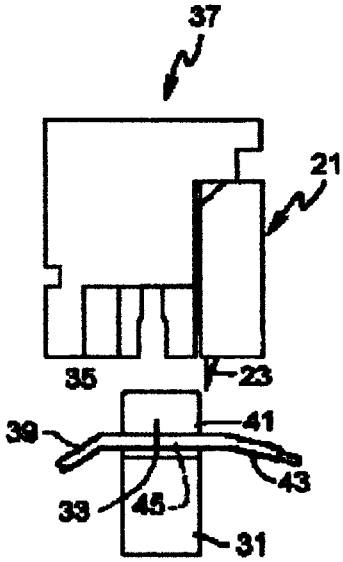
FIG. 3 PRIOR ART
FIG. 3 is a diagrammatic representation of an operationally combined wire-insertion and seating blade block and knife blade support block of a conventional two-piece wire insertion and cutting impact head assembly of FIGS. 1 and 2, operatively aligned with a terminal receptacle of a terminal block.
Figure 4:
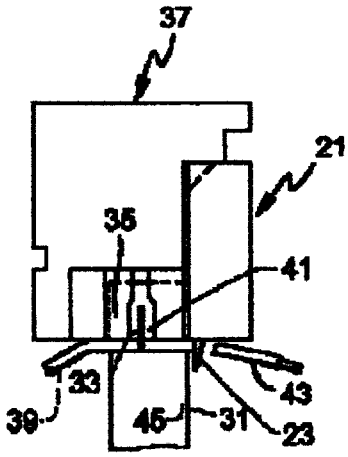
FIG. 4 PRIOR ART
FIG. 4 is a diagrammatic representation of an operationally combined wire-insertion and seating blade block and knife blade support block of a conventional two-piece wire insertion and cutting impact head assembly of FIGS. 1 and 2, operatively aligned with, and actuated against, a terminal receptacle of a terminal block demonstrating the wire insertion and seating blades and knife blades in operative contact with a wire.
Figure 5:
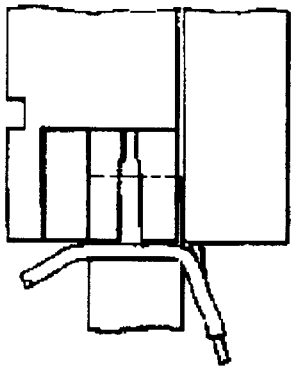
FIG. 5 PRIOR ART
FIG. 5 is a diagrammatic representation of an operationally combined wire-insertion and seating blade block and knife blade support block of a conventional two-piece wire insertion and cutting impact head assembly of FIGS. 1 and 2, demonstrating the unwanted deflection of a knife around a wire jacket.
Figure 6:
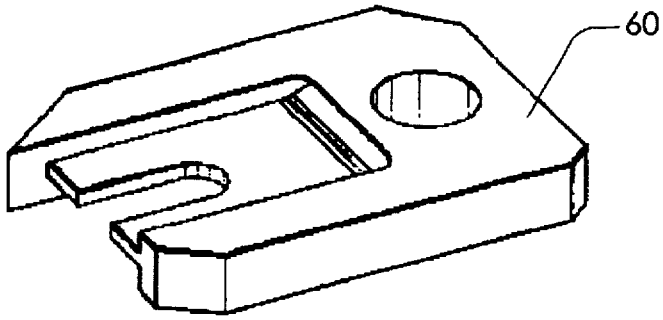
FIG. 6 PRIOR ART
FIG. 6 is a perspective view of the prior art unitary wire seating and cutting blade used in a unitary element impact tool head.
Figure 7:
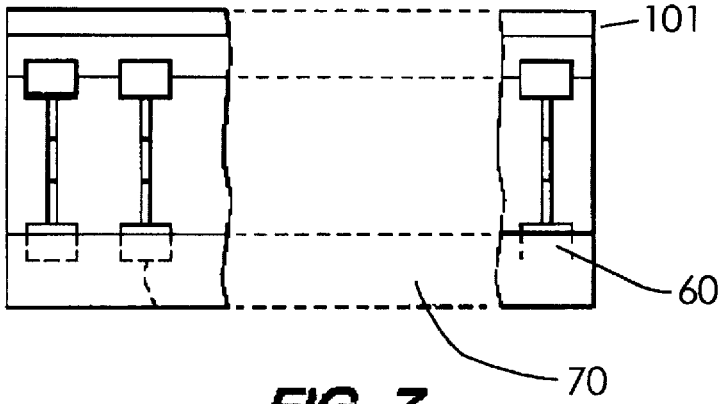
FIG. 7 PRIOR ART
FIG. 7 is a front view of an embodiment of the prior art unitary element impact tool head demonstrating the operative positioning of the unitary wire-seating and cutting blades shown in FIG. 6.
Figure 8:
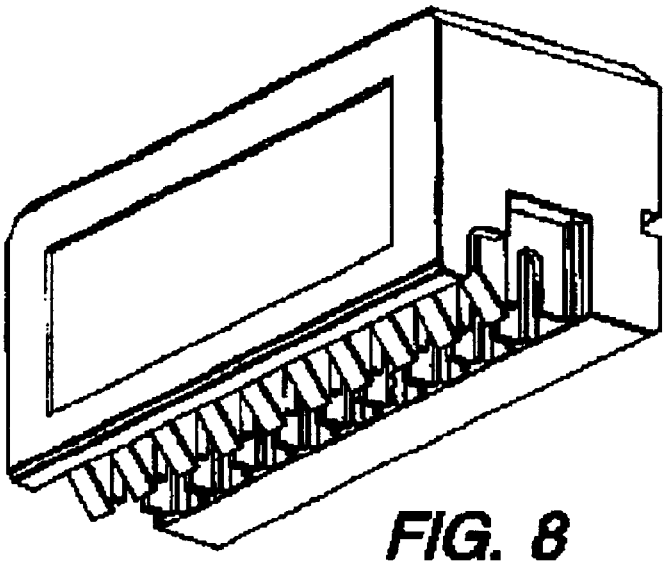
FIG. 8 PRIOR ART
FIG. 8 is a perspective view of an embodiment of the prior art unitary element impact tool head utilizing a plurality the of the unitary wire-seating and cutting blades shown in FIG. 6.
Figure 9:
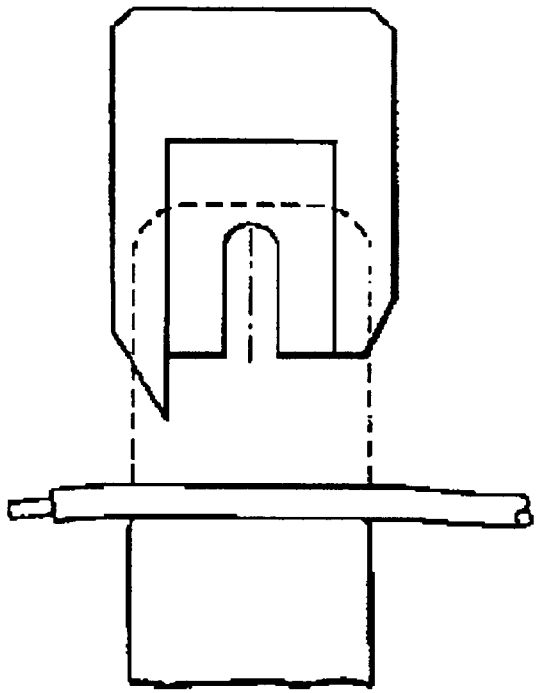
FIG. 9 PRIOR ART
FIG. 9 is a diagrammatic representation of the prior art unitary element impact tool head demonstrating its use operatively aligned with, and actuated against a terminal receptacle of a terminal block such that it is operative to seat and cut a wire.
Figure 17:
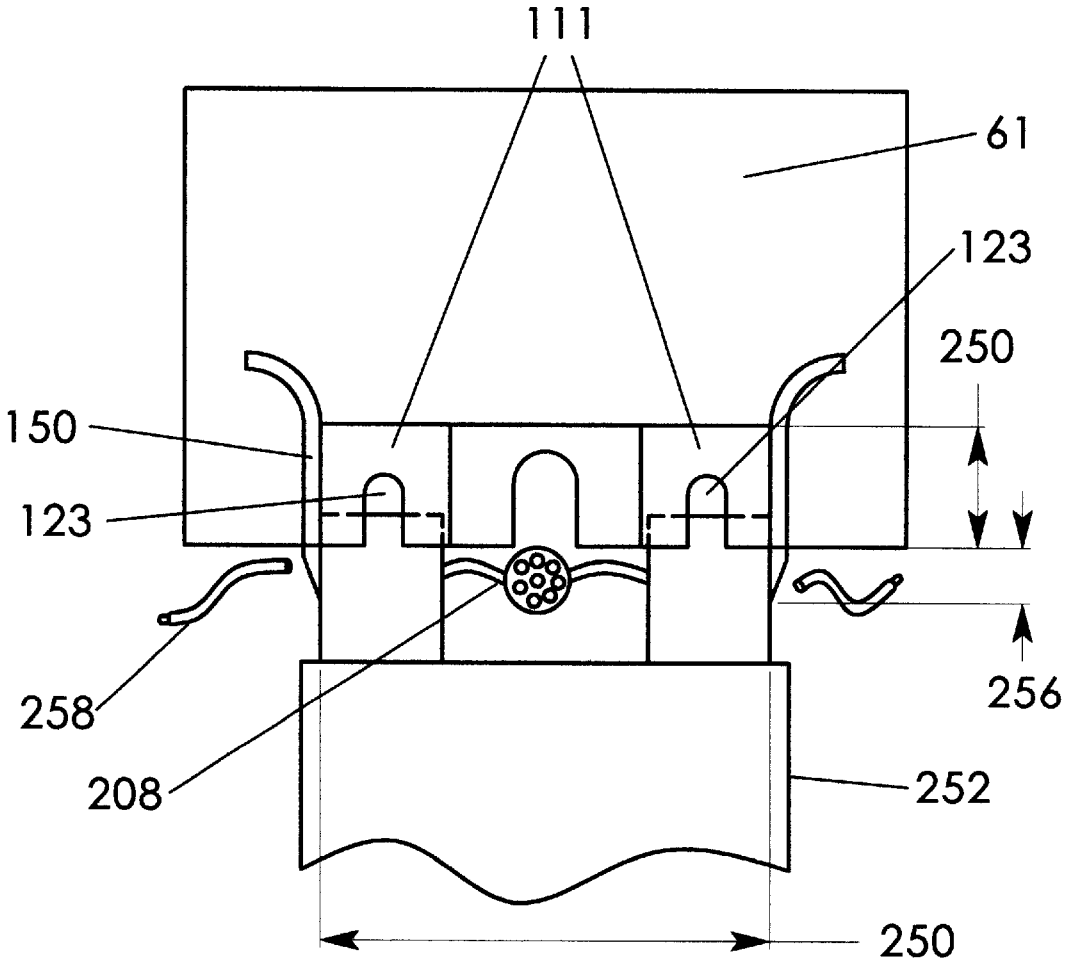
FIG. 17 is a diagrammatic representation of the impact tool head demonstrating its use operatively aligned with, and actuated against a terminal receptacle of a terminal block such that it is operative to seat and cut a wire.

A diagrammatic representation of the impact tool head demonstrating its use in operative alignment with, and actuated against a terminal receptacle of a terminal block of the type shown in FIG. 16, such that it is operative to seat and cut a wire in a wire terminal groove of the terminal block is presented in FIG. 17. Here, the dimensions of the impact tool head have been selected to fit the particular terminal block such that the distance 250 between the wire-cutting blade sets 150 provides sufficient clearance for the terminal block body 252 to fit and to be guided therebetween. The height 254 by which the pressing blade pairs 111 extend from the support body block 101 is chosen such that when the impact tool head is actuated against the terminal block, the pressing blade pairs 111 extend into the wire terminal grooves 204 of the terminal block (see FIG. 16), pressing the individual wires 208 into them. Also, the dimensions of the straddle portions 123 of the pressing blades pairs 111 are chosen such that they do not contact the electrically conductive contacts 106 (see FIG. 16), but still press the individual wires 208 onto the electrically conductive contacts 106 with sufficient force to cause the electrically conductive contacts 206 to penetrate and electrically contact the individual wires. Furthermore, the distance 256 by which the cutting blades 150 extend beyond the generally planar surface 109 of the impact tool head (see FIG. 1 also) is chosen such that when the impact tool head is actuated against the terminal block, the cutting blades 150 cut the wires 208 against the longitudinal anvil-ridge portions 212 of the terminal block (see FIG. 16 also), leaving wire clippings 258. Additionally, the longitudinal groove 103 of the impact tool head is geometrically configured to accommodate the multiple-wire cable 210 residing in the longitudinal wire receptacle 202 of the terminal block.

Figure 18:
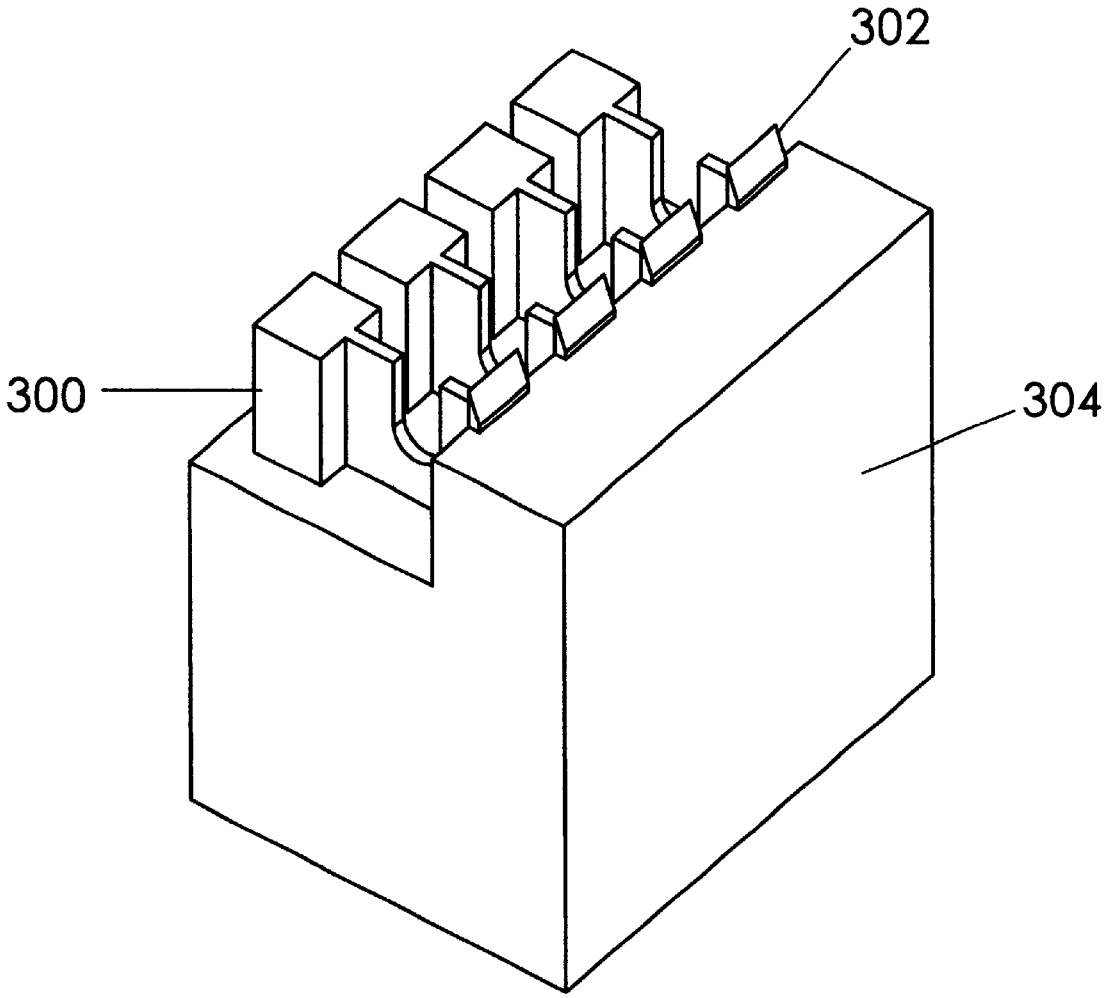
FIG. 18 is a perspective view of a second preferred embodiment of the impact tool head in a configuration including one set of cutting blades and individual pressing blades.
Figure 19:
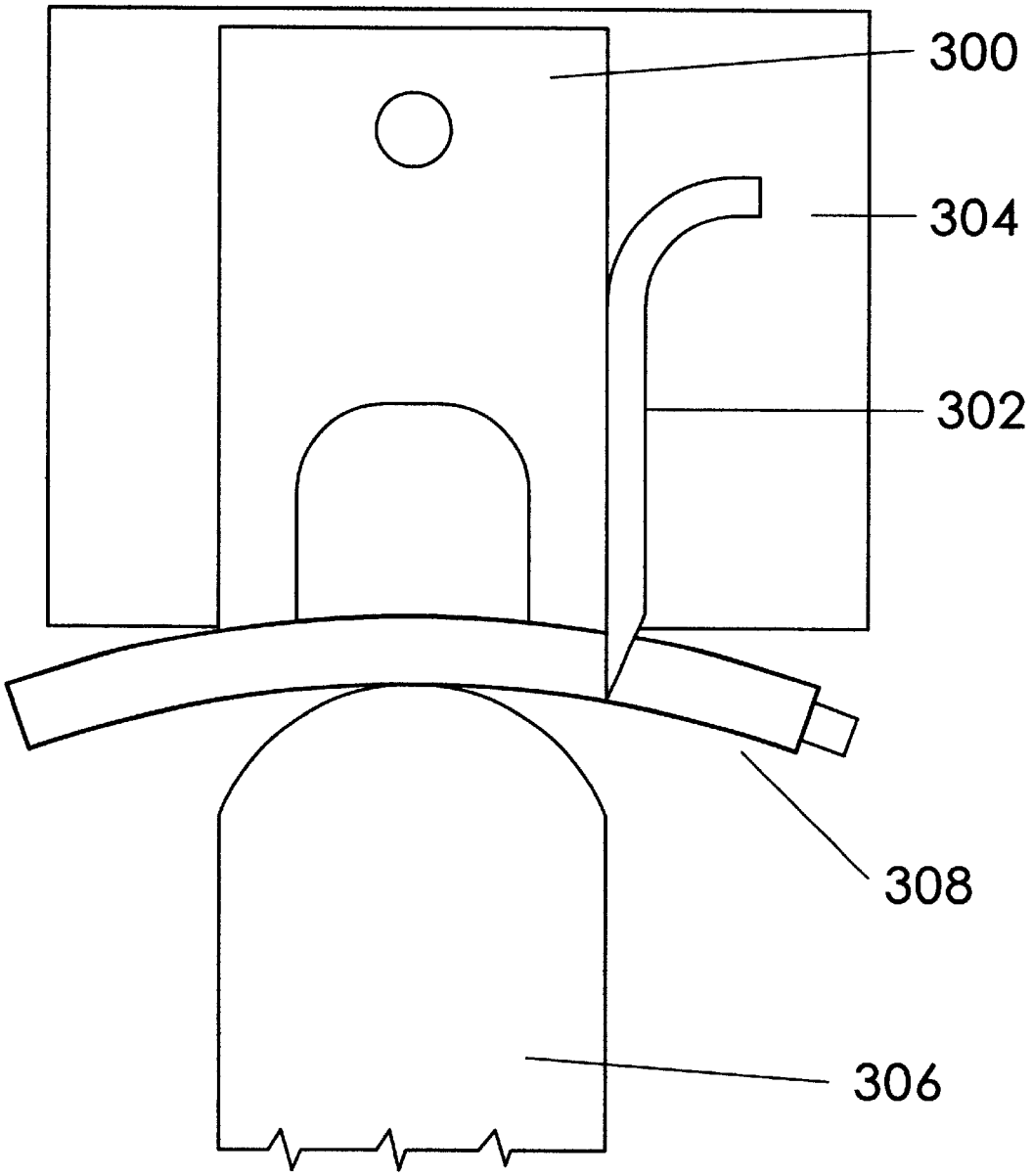
FIG. 19 is a cutaway side view of a second preferred embodiment of the impact tool head as shown in FIG. 18 operatively aligned with, and actuated against a terminal block.

The multiple component design of the impact tool head disclosed herein, although described above in a configuration compatible with an RJ-45 terminal block, is readily adaptable to other terminal block configurations. An example of a second preferred embodiment of the impact tool head is a design for use with a single strip of a Lucent 110-style terminal block is shown in perspective view in FIG. 18, utilizing one set of cutting blades 302 and pressing blades 300 configured as unitary pressing blades set into the impact tool head block 304. A cutaway drawing of the second preferred embodiment of the impact tool head aligned with, and actuated against, a single strip of a Lucent 110-style terminal block is shown in FIG. 19. In this figure, the impact tool head 304 is actuated against the terminal block 306, causing the cutting blades 302 and the pressing blades 304 to respectively seat and cut a terminal wire 308 therein. Using an impact tool head with this configuration, a number of wires may be seated and cut at one time along a strip. Additionally, though not shown in the figures, the impact tool head disclosed herein may be adapted to seat and cut wires along two or more strips of a terminal block having a configuration geometrically similar to that of a Lucent 110-type terminal block.

As can be seen by the preferred embodiments above, the design of this impact tool head may be easily adapted to the requirements of many more terminal blocks than presented. Thus, foregoing descriptions of the preferred embodiments of the invention have been presented for purposes of illustration and description. It is neither intended to be exhaustive nor to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. An impact tool head comprising:

a support body block;

at least one set of pressing blade pairs, each pressing blade pair having a first pressing blade having a pressing surface and a second pressing blade having a pressing surface;

two cutting blade sets integrally molded in the body support block, each of the cutting blade sets having at least one cutting blade having a cutting end; and a body support block in which the pressing blade pairs and cutting blade sets are integrally molded such that each cutting end is operationally located relative to a pressing blade, the body support block further including a longitudinal groove formed between the first pressing blade and the second pressing blade of the pressing blade pairs to accommodate a multiple-wire cable residing in a longitudinal wire receptacle of a terminal block;

wherein the pressing blade pairs are formed as single pieces connected by a breakable center portion formed therebetween such that after molding in the body support block, the breakable center portions reside in the longitudinal groove of the body support block so that they may then be removed to prevent electrical conduction between the first pressing blade and the second pressing blade of the pressing blade pairs.

2. An impact tool head as set forth in claim 1, wherein the cutting ends extend beyond the body support block by a distance exceeding that of the thickness of a wire to be cut, such that the wire is completely seated by the pressing blades and completely severed by the cutting blades during operation of the impact tool.

3. An impact tool head as set forth in claim 1, wherein the cutting ends are bevel-shaped.

4. An impact tool head as set forth in claim 1, wherein the cutting blade sets are made of hardened metal.

5. An impact tool head as set forth in claim 1, wherein the cutting blade sets are made of 440C steel.

6. An impact tool head as set forth in claim 1, wherein the pressing blade pairs are made of a carbon composite material.

7. An impact tool head as set forth in claim 1, wherein the pressing blade pairs are made of beryllium copper.

8. An impact tool head comprising:

a support body block;

at least one pressing blade set having at least one pressing blade with each pressing blade having a first pressing surface and a second pressing surface;

at least one cutting blade set having at least one cutting blade, with each cutting blade having a cutting end; and a body support block in which the pressing blade sets and cutting blade sets are integrally molded such that each cutting end is operationally located relative to a pressing blade;

wherein the sets of cutting blades are formed with arched locking portions and breakaway portions; with the arched locking portions formed adjacent to the cutting ends and forming an arc within the body support block to mechanically affix the sets of cutting blades therein; and with the breakaway portions formed adjacent to the arched locking portions and opposite the cutting ends such that the breakaway portions extend beyond the body support block so that they may be removed after molding.

9. An impact tool head as set forth in claim 8, wherein the cutting ends extend beyond the body support block by a distance exceeding that of the thickness of a wire to be cut, such that the wire is completely seated by the pressing blades and completely severed by the cutting blades during operation of the impact tool.

10. An impact tool head as set forth in claim 8, wherein the cutting ends are bevel-shaped.

11. An impact tool head as set forth in claim 8, wherein the cutting blade sets are made of hardened metal.

12. An impact tool head as set forth in claim 8, wherein the cutting blade sets are made of 440C steel.

13. An impact tool head as set forth in claim 8, wherein the pressing blade pairs are made of a carbon composite material.

14. An impact tool head as set forth in claim 8, wherein the pressing blade pairs are made of beryllium copper.

15. A method of installing and cutting one or more wires in a terminal block receptacle including the steps of:

a. providing an impact tool comprising:

a support body block;

at least one set of pressing blade pairs, each pressing blade pair having a first pressing blade having a pressing surface and a second pressing blade having a pressing surface;

two cutting blade sets integrally molded in the body support block, each of the cutting blade sets having at least one cutting blade having a cutting end; and a body support block in which the pressing blade pairs and cutting blade sets are integrally molded such that each cutting end is operationally located relative to a pressing blade, the body support block further including a longitudinal groove formed between the first pressing blade and the second pressing blade of the pressing blade pairs to accommodate a multiple-wire cable residing in a longitudinal wire receptacle of a terminal block;

wherein the pressing blade pairs are formed as single pieces connected by a breakable center portions formed therebetween such that after molding in the body support block, the breakable center portions reside in the longitudinal groove of the body support block so that they may then be removed to prevent electrical conduction between the first pressing blade and the second pressing blade of the pressing blade pairs; and b. placing the impact tool into contact with one or more wires placed in the receptacles of a terminal block; and c. actuating the impact tool so as to cause the pressing blades to seat the wires in the receptacles such that they contact the wire contacts therein and to cause the cutting ends to cut the wires against the terminal block.

* * * * *